US006539355B1

(12) United States Patent
Omori et al.

(10) Patent No.: US 6,539,355 B1
(45) Date of Patent: Mar. 25, 2003

(54) SIGNAL BAND EXPANDING METHOD AND APPARATUS AND SIGNAL SYNTHESIS METHOD AND APPARATUS

(75) Inventors: Shiro Omori, Kanagawa (JP); Masayuki Nishiguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/417,585

(22) Filed: Oct. 14, 1999

(30) Foreign Application Priority Data

Oct. 15, 1998 (JP) ..... 10-294010
Oct. 26, 1998 (JP) ..... 10-304301
Oct. 26, 1998 (JP) ..... 10-304302

(51) Int. Cl.[7] ..... G10L 19/02
(52) U.S. Cl. ..... 704/268; 704/223
(58) Field of Search ..... 704/268, 223, 704/205, 266

(56) References Cited

U.S. PATENT DOCUMENTS 5,455,888 A * 10/1995 Iyengar et al. ..... 704/203
5,581,652 A * 12/1996 Abe et al. ..... 704/222
5,950,153 A * 9/1999 Ohmori et al. ..... 704/217
5,978,759 A * 11/1999 Tsushima et al. ..... 704/223
6,289,311 B1 * 9/2001 Omori et al. ..... 704/268

FOREIGN PATENT DOCUMENTS

EP 0732687 A2 * 9/1996 ..... 704/223

* cited by examiner

*Primary Examiner*—Marsha D. Banks-Harold
*Assistant Examiner*—Donald L. Storm
(74) *Attorney, Agent, or Firm*—Jay H. Maioli

(57) ABSTRACT

A bandwidth expanding method and apparatus in which frequency characteristics of high-frequency components of broad band signals can be adjusted to the liking of the user, overflow due to addition is prevented from occurring without power variations being perceived by a user, the number of broad band formants is reduced, and emphasis is attached to the rough structure of the spectrum, so that the produced broad band speech signals can be improved in quality. To this end, in a speech bandwidth expansion device, frequency characteristics of the frequency components not less than 3400 Hz are adjusted by preset alterable parameter values and summed to the original narrow band speech components. If overflow has occurred in a sample, the high-range gain of the sample is lowered to a level below the overflow level before proceeding to addition. Also, broad band autocorrelation γw is generated and inverse-transformed in an inverse parameter conversion unit to produce broad band linear prediction coefficient αW to synthesize the broadband speech in a linear predictive coding synthesis unit.

27 Claims, 8 Drawing Sheets

SIGNAL BAND EXPANDING METHOD AND APPARATUS AND SIGNAL SYNTHESIS METHOD AND APPARATUS

BACKGROUND OF THE INVENTION

1. Field of the Invention

This invention relates to a signal band expanding method and apparatus and signal synthesis method and apparatus in which speech signals of a narrow frequency range, transmitted by communication or broadcasting or stored in a medium, or parameters making up the signals, are transmitted over a transmission path or directly recorded on the medium, so as to be used on the reception or reproducing side for estimating the broad-band speech signals on the receiving or reproducing side, and which may be used with advantage especially in a portable telephone terminal having the band expanding function.

2. Description of the Related Art

The bandwidth of the telephone network is narrow such as 300 to 3400 such that limitations are imposed on the frequency band of speech signals sent over the telephone network. Therefore, the sound quality of the conventional analog telephone network cannot be said to be optimum. The digital portable telephone also is not satisfactory in sound quality.

However, since the standard of the transmission path is fixed, it is difficult to enlarge its bandwidth. Thus, a variety of systems are now proposed for predicting signal components outside the band on the receiving side to generate broad-band signals.

In particular, in systems exploiting the vector sum excited linear prediction (VSELP) coding or pitch synchronization innovation—code excited linear prediction (PSI-CELP), which are the speech codec system for car/portable telephone in Japan, attention is directed to LPC synthesis, both the linear prediction coefficients $\alpha$ and the excitation source are enlarged in the frequency range and LPC synthesis is made by $\alpha$ and the excitation source of the broad bandwidth.

However, the broad band-speech, thus obtained, suffers from distortion. Therefore, in the frequency component contained in the original speech, the original speech is naturally of higher quality, and hence these components contained in the synthesized broad-band speech are filtered off and summed to the original speech.

For combatting the overflow in the digital signal processing, there are known methods of clipping the digital signal to a maximum value or of adjusting the gain of the entire signal to prevent signal overflow.

However, if overflow occurs in the process of addition of main signals and sub-signals, and it is desired not to change the main signal even if the sub-signal is eliminated in its entirety, these overflow combatting measures are not optimum.

There is also known a technique in which the speech of the vector sum excited linear prediction (VSELP) coding and pitch synchronization innovation—code excited linear prediction (PSI-CELP) coding system, as the speech codec of the car/portable telephone in the personal digital cellular (PDC) system, having the frequency bandwidth of 300 to 3400 Hz, is enlarged in bandwidth to approximately 300 to 6000 Hz by estimating the signal components outside the band on the receiving side. In this technique, the signals outside the transmission bandwidth is synthesized and summed to the narrow band signals corresponding to the original speech signals.

Among transmitted narrrow band parameters, there are a linear prediction coefficient $\alpha$, a reflection coefficient k and a line spectrum pair (LSP). These represent the speech spectrum envelope, with the number of orders of the coefficients corresponding to peaks of the spectrum. In the PDC system, up to the tenth order coefficients are transmitted, in consideration that the number of formants in the human voice up to approximately 3400 Hz is on the order of five.

One of a wide variety of possible prediction methods for the wide range parameter representing the wide band formant exploits vector quantization. In this method, a number of vectors corresponding to the number of orders of the broad band parameters are prepared by previous learning and, on inputting of the narrow band parameter, a suitable broad band vector is selected from these parameters as the broad band parameter.

It has now been found that, in the broad band speech, thus synthesized, there exists a marked difference in personal appreciation of the sound quality and hence it is preferred not to fix the gain of the high range component synthesized by prediction. Similarly, the high range component not less than 6 kHz, for which the general preference is moderate suppression, also is preferably not fixed.

It is therefore an object of the first subject-matter of the present invention to provide a bandwidth expanding method and apparatus in which frequency characteristics of high-frequency components can be adjusted to the liking of users.

On the other hand, in the above-described bandwidth expansion technique, overflow by addition is eventually produced. However, the main signal needs to be the original signal at any rate, while the component outside the transmission band is not needed at the cost of generation of extraneous sound ascribable to overflow.

It is therefore not desirable to clip the signal at the maximum value to produce extraneous sound or to adjust the entire signal to produce perceptible power variations, and hence an alternative overflow combatting technique is desired.

It is therefore an object of the second subject-matter of the present invention to provide a signal processing method and apparatus for suppressing overflow by adjusting only the signals of the subsidiary system.

It is also an object of the second subject-matter of the present invention to provide a bandwidth expanding method and apparatus in which it is possible to suppress overflow and to expand the bandwidth without changing the low range signals to improve spontaneity in hearing.

In addition, in estimating and synthesizing the broad-band speech from the narrow band parameters, transmitted as described above, the number of formants naturally is larger than that for the narrow bands, that is five.

The increased number of formants is not meritorious since comparison is then made of finer components of the spectrum envelope to depart from the inherent intention of roughly estimating the broad-band spectrum envelope.

It is therefore an object of the third subject-matter of the present invention to provide a speech band expanding method and apparatus and speech synthesis method and apparatus in which the number of broad-band formants can be diminished, importance can be attached to the rough structure of the spectrum, the broad-band speech can be improved in quality and in which the processing volume required in the memory capacity and codebook searching can be saved.

SUMMARY OF THE INVENTION

In connection with the first subject-matter, the present invention provides a bandwidth expanding method for expanding a bandwidth by estimating, from narrow-band signals or from parameters allowing for synthesizing the narrow-band signals, outside-band components, and by adding the outside-band components to the narrow-band signals, wherein frequency characteristics of the outside-band components are first adjusted by pre-set alterable parameter values and subsequently the outside-band components are added to the narrow-band signals.

In connection with the first subject-matter, the present invention provides a bandwidth expanding apparatus for expanding the bandwidth by estimating, from narrow-band signals or from parameters allowing for synthesizing the narrow-band signals, outside-band components, and by adding the outside-band components to the narrow-band signals, wherein the apparatus includes frequency characteristics adjustment means for adjusting frequency characteristics of the outside-band components by pre-set alterable parameter values, and addition means for adding the outside-band components, the frequency characteristics of which have been adjusted by the frequency characteristics adjustment means, to the narrow-band signals.

In connection with the first subject-matter, the present invention provides a bandwidth expanding apparatus for expanding the bandwidth by estimating, from narrow-band signals or from parameters allowing for synthesizing the narrow-band signals, outside-band components, and by adding the outside-band components to the narrow-band signals, including addition means for adding the outside-band components to the narrow-band signals, and frequency characteristics adjustment means for adjusting the frequency characteristics of the outside-band components for adjusting frequency characteristics of the outside-band components of an addition output of the addition means by pre-set alterable parameters.

In connection with the second subject-matter, the present invention provides a signal processing method for adding signals of a main system to signals of a subsidiary system, wherein, before adding the signals of the subsidiary system to the signals of the main system, the gain of a given sample of the signals of the sub-system and the gain of samples following the given sample are adjusted based on the presence or absence of the overflow that can be determined from an amount of addition.

In connection with the second subject-matter, the present invention provides a signal processing apparatus for adding signals of a main system to signals of a subsidiary system, including addition means for summing the signals of the subsidiary system to signals of the main system, overflow detection means for detecting the presence or absence of overflow that can be verified from an amount of addition from the addition means, gain adjustment means for adjusting the gain for the given sample and the following samples of the signals of the subsidiary system based on the detected results from the overflow detection means, and multiplication means for multiplying the given and following samples of the signals of the subsidiary system by an adjustment gain from the gain adjustment means.

In connection with the second subject-matter, the present invention provides a bandwidth expanding method for expanding the bandwidth by estimating, from narrow-band signals or from parameters allowing for synthesizing the narrow-band signals, outside-band components, and by adding the outside-band components to the narrow-band signals, wherein, before adding the outside-band components to the narrow-band signals, the gain of the outside-band components is adjusted based on the presence or absence of overflow that can be determined from an amount of addition.

In connection with the second subject-matter, the present invention provides a bandwidth expanding apparatus for expanding the bandwidth by estimating, from narrow-band signals or from parameters allowing for synthesizing the narrow-band signals, outside-band components, and by adding the outside-band components to the narrow-band signals, wherein the apparatus includes addition means for summing the outside-band components to the narrow-band signals, overflow detection means for detecting the presence or absence of overflow that can be verified from an amount of addition from the addition means, gain adjustment means for adjusting the gain for the given sample and the following samples of the outside-band components based on detected results from the overflow detection means and multiplication means for multiplying the given and following samples of the outside-band components by an adjustment gain from the gain adjustment means.

In connection with the third subject-matter, the present invention provides a speech bandwidth expanding method including a parameter extraction step for producing from input narrow band signals aparameter that allows representation of the narrow-range formant, a parameter prediction step for predicting a parameter that allows representation of a number of broad band formants not larger than the number of the produced narrow-band formants from the input narrow band speech signal, and a synthesis step for synthesizing the broad-band speech from a parameter that allows for representation of the produced broad band formants.

In connection with the third subject-matter, the present invention provides a speech bandwidth expanding apparatus including parameter extraction means for producing from input narrow band signals a parameter that allows representation of the narrow-range formant, parameter prediction means for predicting a parameter that allows representation of a number of broad band formants not larger than the number of the produced narrow-band formants, and synthesis means for synthesizing the broad-band speech from a parameter that allows for representation of the produced broad band formants.

In connection with the third subject-matter, the present invention provides a speech synthesis method including a first parameter extraction step for predicting parameters that allow for representation of a number of the broad band formants not larger than the number of narrow band narrow band formants from narrow band parameters representing the input narrow band speech and which allow for representation of the input narrow band speech, a parameter extraction step for producing parameters that allow representation of the narrow-range formant information from the input narrow band speech, a second parameter prediction step for predicting a parameter that allows representation of a number of broad band formants not larger than the number of the produced narrow-band formants, and a synthesis step for synthesizing the broad-band speech from a parameter that allows for representation of the produced broad band formants.

In connection with the third subject-matter, the present invention provides a speech synthesis apparatus including first parameter extraction means for predicting parameters that allow for representation of a number of the broad band formants not larger than the number of narrow band narrow band formants from narrow band parameters representing the input narrow band speech and which allow for representation of the input narrow band speech, parameter extraction means for producing parameters that allow representation of the narrow-range formant information from the input narrow band speech, second parameter prediction means for predicting a parameter that allows representation of a number of broad band formants not larger than the number of the produced narrow-band formants, and synthesis means for synthesizing the broad-band speech from a parameter that allows for representation of the produced broad band formants.

With the bandwidth enlarging method and apparatus according to the first subject-matter of the present invention, the frequency characteristics of high frequency components, such as gain, is rendered alterable to provide the broad-band speech suited to the liking of the user.

With the signal processing method and apparatus according to the second subject-matter of the present invention, it is possible to make the best use of the characteristics of the main system signals because overflow can be prevented from occurring by adjusting only the signals of the subsidiary system.

With the bandwidth enlarging method and apparatus according to the second subject-matter of the present invention, it is possible to prevent overflow without changing the low range side signals as main system signals and to enlarge the bandwidth to improve spontaneity in hearing.

With the speech band enlarging method and apparatus and the speech synthesis method and apparatus according to the third subject-matter of the present invention, in which the broad-band speech is predicted and synthesized from the narrow band speech or from the narrow band parameters, it is possible to diminish the number of formants of the synthesized broad-band speech to attach more importance to the rough spectral structure to improve the quality of the produced broad-band speech as well as to save the memory capacity and the processing volume required in codebook search.

DESCRIPTION OF THE PREFERRED EMBODIMENTS

Figure 1:
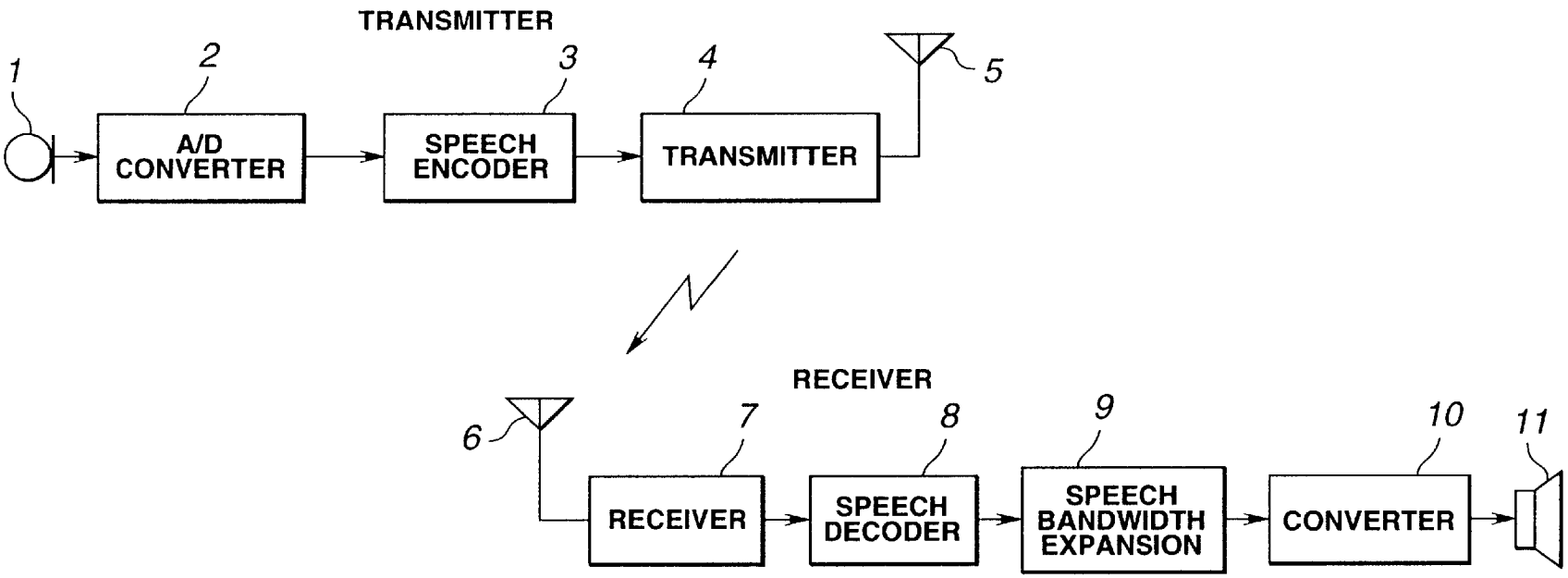
FIG. 1 is a block diagram of a digital portable telephone device to which a speech bandwidth expansion device embodying the present invention is applied.

Referring to the drawings, preferred embodiments of the first subject-matter of the present invention will be explained in detail. This embodiment is directed to a speech bandwidth expanding device. This embodiment is directed to a speech bandwidth expanding device for enlarging the bandwidth of an input narrow-band speech by employing the bandwidth expanding method according to the present invention. In the bandwidth expanding method, used by the present speech bandwidth expanding device, frequency components outside the input narrow-band range are predicted from parameters, from which narrow band signals, limited on the transmission path, can be synthesized, and the predicted components are summed to the narrow-band signals, synthesized from the parameters, to enlarge the bandwidth. Specifically, the frequency characteristics of the components outside the input narrow-band range are adjusted by variable parameter values given at the outset according to the demand by the user, and are subsequently added to the narrow band signal. This method will be explained in detail subsequently.

This speech bandwidth expanding device is applied to a digital portable telephone device. First, the structure of the present digital portable telephone device is explained. Although the transmitter side and the receiver side are explained herein separately, these are actually enclosed together in a sole portable telephone device.

The transmitter side converts speech signals, entered at a microphone 1, into digital signals, by an AID converter 2, and encoded by a speech encoder 3. Output bits are processed for transmission by a transmitter 4 and transmitted over an antenna.

At this time, the speech encoder 3 sends to the transmitter 4 encoded parameters which take into account the bandwidth narrowing limited by the transmission path. Examples of the encoding parameters include parameters concerning the excitation source and linear prediction coefficients $\alpha$.

The receiver side receives the electric wave captured by the antenna 6 by a receiver 7. A speech decoder 8 decodes the encoding parameters. A speech bandwidth expanding device 9 expands the speech using the decoded parameters. The speech then is restored to analog signals by a D/A converter 10 and outputted at a speaker 11.

Figure 2:
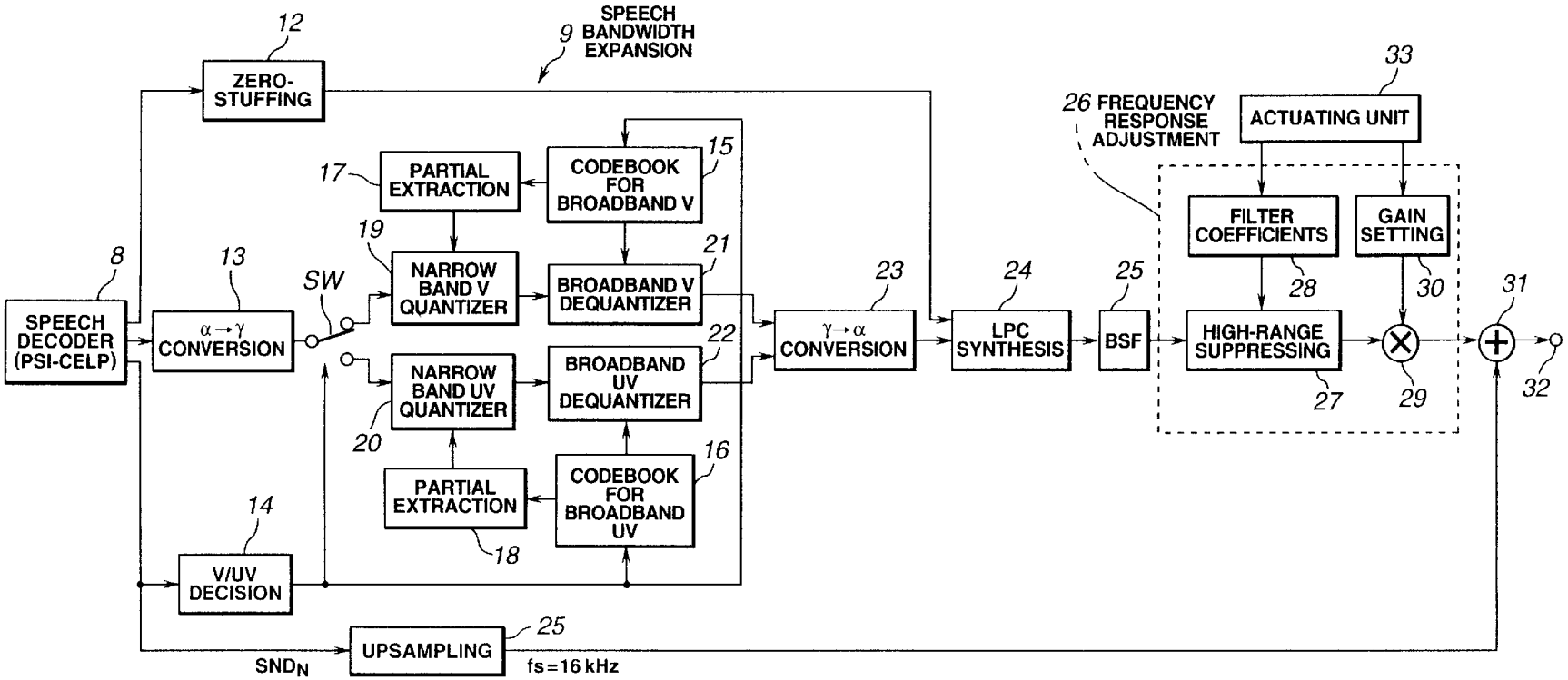
FIG. 2 is a block diagram showing a first embodiment of the speech bandwidth expansion device according to the first subject-matter of the present invention.

A first embodiment of the speech bandwidth expanding device 9 in this digital portable telephone device is shown in FIG. 2. This speech bandwidth expanding device 9, shown in FIG. 2, expands the bandwidth of the speech using the encoded parameters sent from the speech encoder 3 arranged on the transmitter side of the digital portable telephone device.

The encoded parameters are decoded by the speech decoder 8. If the encoding method used in the speech encoder 3 is the pitch synchronous innovation-CELP (PSI-CELP) encoding system, the decoding method by this speech decoder 8 is also of the PSI-CELP system.

The parameters concerning the excitation source, as the first encoding parameter among the encoded parameters, are routed to a zero-padding unit 12. The linear pediction coefficients $\alpha$, as the second encoded parameter among the above-mentioned encoded parametera, are routed to an $\alpha$ to $\gamma$ conversion circuit 13 adapted for conversion from linear prediction coefficients to autocorrelation. Also, decoded signals from the speech decoder 8 are routed to a V/UV decision circuit 14.

The speech bandwidth expanding device 9 includes, in addition to the zero-padding unit 12, $\alpha$ to $\gamma$ conversion circuit 13 and the V/UV decision circuit 14, a codebook for broad-band voiced sound 15 and a codebook for broad-band unvoiced sound 16. These codebooks 15, 16 are formulated at the outset using parameters for voiced speech and unvoiced speech, extracted from the broad-band voiced and unvoiced speech, respectively.

The speech bandwidth expanding device 9 also includes a partial extraction circuit 17 and a partial extraction circuit 18, for partially extracting respective code vectors in the codebook for broad-band voiced sound 15 and the codebook for broad-band unvoiced sound 16, to find narrow-band parameters, and a quantizer for narrow-band voiced speech 19 for quantizing the autocorrelation for narrow-band voiced speech from the α to γ conversion circuit 13, using narrow-band parameters from the partial extraction circuit 17. The speech bandwidth expanding device 9 also includes a quantizer for narrow-band unvoiced speech 20 for quantizing the autocorrelation for narrow-band unvoiced speech from the α to γ conversion circuit 13, using narrow-band parameters from the partial extraction circuit 18. The speech bandwidth expanding device 9 also includes a dequantizer for broad-band voiced speech 21 for dequantizing the quantized data for narrow-band voiced speech from the quantizer for narrow-band voiced speech 19 using the codebook for broad-band voiced sound 15 and a dequantizer for broad-band unvoiced speech 22 for dequantizing quantized data for narrow band unvoiced sound from the quantizer for narrow-band unvoiced speech 20 using the codebook for broad-band unvoiced sound 16. The speech bandwidth expanding device 9 also includes a autocorrelation to linear prediction coefficient conversion circuit (γ to α conversion circuit 23) for converting the autocorrelation for broad-band voiced speech, which proves the dequantized data from the dequantizer for broad-band voiced speech 21 into linear prediction coefficients for broad-band voiced speech and for converting the autocorrelation for broad-band unvoiced speech, which proves the dequantized data from the dequantizer for broad-band unvoiced speech 22, into linear prediction coefficients for broad-band unvoiced speech. The speech bandwidth expanding device 9 also includes a LPC synthesis circuit 24 for synthesizing the broad-band speech based on the linear prediction coefficients for broad-band voiced speech, linear prediction coefficients for broad-band unvoiced speech from the γ to α conversion circuit 23 and the excitation source from the zero-padding unit 12.

The speech bandwidth expanding device 9 also includes an upsampling circuit 25 for oversampling the sampling frequency for the narrow-band speech data decoded by the speech decoder 8 from 8 kHz to 16 kHz, and a band-stop filter (BSF) 25 for removing signal components of the frequency range of narrow-band input speech data of 300 to 3400 kHz from a synthesized output from the LPC synthesis circuit 24.

The speech bandwidth expanding device 9 further includes a frequency response adjustment unit 26 for adjusting the frequency response of high-frequency components not less than 3400 kHz from the BSF 25 by a pre-set variable parameter value, and an adder 31 for summing the frequency components not less than 3400 kHz, adjusted in frequency response by the frequency response adjustment unit 26, to the original narrow-band speech data components of 300 to 3400 kHz from the upsampling circuit 25.

From an output terminal 32, digitsl speech signals having the frequency range of 300 to 7000 Hz and the sampling frequency of 16 kHz are outputted.

The frequency response adjustment unit 26 adjusts the frequency range of the frequency components other than the above range by a high range suppression filter 27. The high range suppression filter 27 suppresses the components not less than approximately 6 kHz to render the components outside the above range more amenable to ears. To the high range suppression filter 27 is connected a filter coefficient holding memory 28. In this filter coefficient holding memory 28, there are stored several filter coefficients which render the attenuation of the frequency response more gentle or more steep. These filter coefficients are selected depending on the actuation by the user on an actuation unit 33. The high range suppression filter 27 uses the filter coefficients, selected according to the user's liking, to adjust the frequency range other than the above range.

The frequency response adjustment unit 26 also adjusts the gain of the components other than the above range. Specifically, several gain setting values are stored in a gain setting value memory 30 and selected according to the user's liking on the actuation unit 33 so as to be supplied to a multiplier 29. Thus, in the multiplier 29, the gain of the component other than the above range can be adjusted according to the user's demand.

This speech bandwidth expanding device 9 in its entirety operates as follows: First, the speech bandwidth expanding device 9 estimates parameters for a broad range from parameters for a narrow range to find the speech signals for broad range by the LPC synthesis circuit 24. That is, the speech bandwidth expanding device 9 then substitutes the low-range side corresponding to the frequency range of the original speech for the original speech. Specifically, the device uses the BSF 25 as the high pass filter to leave only the high range and suppresses the highest frequency component of the high range by the high range suppression filter 27. The device then adjusts the gain by the signal processor 29 to sum the resulting signal to the original speech.

For estimating the broad range parameters, it is necessary to enlarge not only the band for α but also that of the excitation source. For enlarging the band for α, a codebook by the autocorrelation γ, as a parameter that can be converted to and from α, needs to be formulated at the outset. The autocorrelation γ is enlarged in the frequency range by quantization and dequantization by the codebook.

First, the band enlargement for α is explained. Taking into account the fact that α is a filter coefficient representing the spectral envelope, it is first converted into the autocorrelation γ, which is a parameter representing another spectral envelope which allows for estimation of the high range side more easily. This autocorrelation γ is enlarged in the frequency range and subsequently converted from the broad-range autocorrelation γw back to αw. For expansion, vector quantization is used. It suffices if the narrow-band autocorrelation γn is vector-quantized and to find the corresponding γw from its index.

Since a predetermined relationship holds between the narrow-band autocorrelation and broad-band autocorrelation, as later explained, it suffices to provide only a codebook by broad-band autocorrelation. The narrow-band autocorrelation can thereby be vector-quantized and dequantized to find the broad-band autocorrelation.

If assumed that the narrow-band autocorrelation is the band-limited broad-band autocorrelation, the following relation:

$$\Phi(x_n)=\Phi(x_w\hat{X}h)=\Phi(x_w)\hat{X}\Phi(h) \quad (1)$$

holds between the narrow-band autocorrelation and the broad-band autocorrelation, where Φ is autocorrelation, xn is the narrow-band signal, xw is the broad band signal and h is the impulse response of the band-limiting filter.

From the relation between the autocorrelation and the power spectrum, the following equation (2):

$$\Phi(h)=F^{-1}(|H|^2) \quad (2)$$

is obtained.

If another band-limiting filter, having frequency characteristics equal to power characteristics of the aforementioned band-limiting filter, is considered, and termed H', the above equation may be rewritten to:

$$\Phi(h)=F^{-1}(|H|^2)=F^{-1}(H')=h' \quad (3)$$

The passband and stop band of this new filter are equivalent to those of the initial band-limiting filter, with the attenuation characteristics being squared. In this consideration, the narrow-band autocorrelation may be simplified as being the convolution of the broad-band autocorrelation and the impulse response of the band-limiting filter, that is a band-limited version of the broad-band autocorrelation. That is, the following equation:

$$\Phi(x_n)=\Phi(x_w)\hat{X}h' \quad (4)$$

is derived.

It is seen from above that, in vector quantizing the narrow-band autocorrelation, it is sufficient if only the broad-band codebook is provided, suice the narrow-band autocorrelation required for quantization can be prepared by computation. Thus, there is no necessity of providing a codebook from the narrow-band autocorrelation from the outset.

Moreover, since each γw code vector has a monotonously decreasing curve or a smoothly increasing or decreasing curve, no marked change is produced on allowing the low range to be passed through H', such that γn quantization can be executed directly by a γw codebook. However, since the sampling frequency is ½, it is necessary to perform comparison every other order.

Since α can be expanded to higher precision by splitting into the voiced (V) and the unvoiced (UV), this also is executed. Accordingly, two codebooks, namely a codebook for U and a codebook for UV, are used.

The expansion of the excitation source is now explained. In the PSI-CELP, an excitation source in the narrow band, upsampled on zero stuffing in the zero-padding unit 12 to generate aliasing distortion, is used. Although this method is extremely simple, the excitation source used may be said to be of sufficient quality since the difference of the harmonic structure and the power of the original speech are preserved.

From the broad band α, obtained as described above, and the broad-band excitation source, LPC synthesis is performed by the LPC synthesis circuit 24.

Since the broad-band LPC synthesized speech as such is inferior in quality, its low-range side is replaced by the original speech SNDN outputted by the codec. The component of the synthesized speech higher than 3.4 kHz is extracted, whilst the codec output is upsampled by fs=16 kHz and added to the extracted speech.

At this time, the gain multiplied to the high range side in the multiplier 29 of the frequency response adjustment unit 26 is rendered adjustable according to the liking of the user. This value is rendered variable in view of the marked individual difference from user to user. That is, the high-range side gain is previously set by user input and referred to for multiplication.

Also, the high-range side is filtered prior to addition by the high range suppression filter 27 of the frequency response adjustment unit 26 to slightly suppress the component not less than approximately 6 kHz to render the sound more amenable to the ear. This filter coefficient may be selectable according to the liking of the user. The high range side frequency range can be selected according to the user's liking by processing in the high range suppression filter 27 using the selected filter coefficient.

Since the power characteristics of the low range side are not affected by the processing employing the high range suppression filter 27 of the frequency response adjustment unit 26, the processing may also be applied to the component of the sum output of the adder which is outside the narrow transmission band. That is, the high range suppression filter 27 of the frequency response adjustment unit 26 may be provided on the downstream side of the adder 31. Alternatively, filtering possibly affecting the low range side may also be applied after addition. This produces the broad-range speech.

Figure 5:
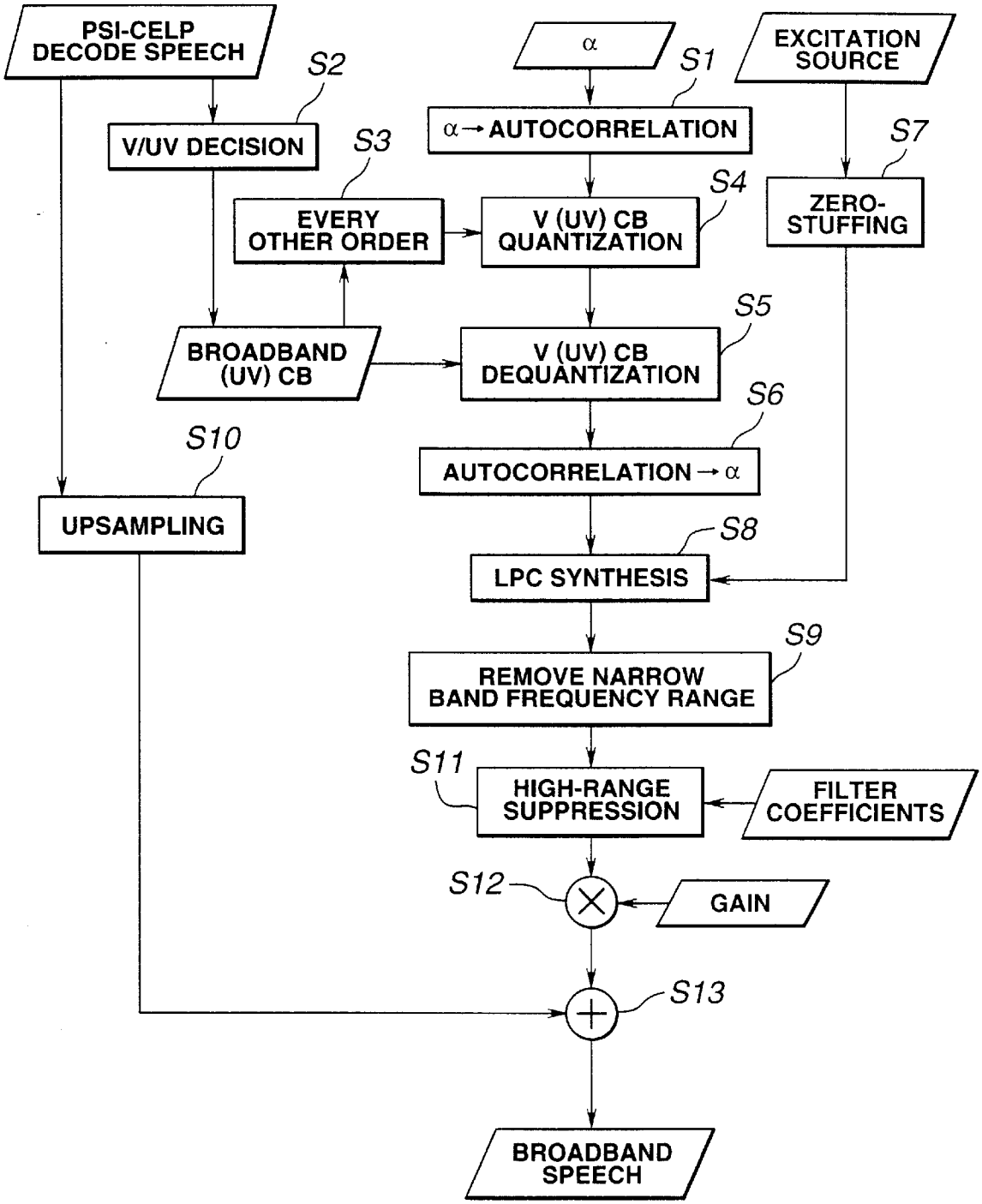
FIG. 5 is a block diagram of an embodiment of the present invention in which the PSI-CELP system is applied to the present invention.

The detailed operation of the speech bandwidth expanding device 9 is now explained by referring to the flowchart of FIG. 5.

At step S1, the α to γ conversion circuit 13 converts the linear prediction coefficient α, decoded by the speech decoder 8, into autocorrelation γ. The signal decoded by the speech decoder 8 is decoded by the V/UV decision circuit 14 at step Surface processed film 2 to verify V/UV.

If the V/UV decision flag is verified at this step S2 to be V, a switch SW, used to change over an output of the α to γ conversion circuit 13, is connected to the quantizer for narrow-band voiced speech 19. If the flag is decided to be UV, the switch SW connects an output of the α to γ conversion circuit 13 to the quantizer for narrow-band unvoiced speech 20.

If the V/UV decision circuit 14 decides the V/UV decision flag to be V, the autocorrelation for voiced speech γ from the switch SW is sent at step S4 to the quantizer for narrow-band V19 for quantization. For this quantization, the parameter for the narrow band V, found at step S3 by the partial extraction circuit 17, is used.

If the V/UV decision circuit 14 decides the V/UV decision flag to be UV, the autocorrelation for voiced speech γ from the switch SW is sent at step S3 to the quantizer for narrow-band UV 20 for quantization. For this quantization, the parameter for the narrow band UV, found by processing by the partial extraction circuit 18, is used.

At step S5, the quantized autocorrelation is dequantized by the dequantizer for broad-band voiced speech 21 or the dequantizer for broad-band unvoiced speech 22, using the codebook for broad-band voiced sound 15 or the codebook for broad-band unvoiced sound 16, respectively, to produce the autocorrelation for broad band.

The autocorrelation for broad band is converted at step S6 to α by the γ to α conversion circuit 13.

On the other hand, the parameter concerning the excitation source is upsampled at step S7 by zero stuffing between samples by the zero-padding unit 12 and enlarged in bandwidth on aliasing. The resulting parameter is sent as the broad-band excitation source to the LPC synthesis circuit 24.

At step S8, the LPC synthesis circuit 24 synthesizes the broad-band α and the broad-band excitation source by LPC synthesis to produce broad-band speech signals.

However, the resulting signals are inferior in quality since these are merely broad-band signals as found by prediction and are corrupted by prediction error. In particular, insofar as the frequency range of the narrow-band input speech is concerned, it is more preferred to directly use the original speech SNDN (input speech) outputted by the codec.

Thus, of the synthesized speech from the LPC synthesis circuit 24, the frequency range of 300 to 3400 Hz of the narrow-band input speech is filtered off at step S9 using the BSF 25.

The filtered output is summed by the adder 29 at step S13 to an upsampled version of the original speech SNDN obtained by the upsampling circuit 25 at step S10. At this time, the high-range side is filtered at step S11 by the high range suppression filter 27 adapted for slightly suppressing the component not lower than approximately 6 kHz to render the sound more amenable to the ear. The filter coefficient can be selected as described above.

At step S12, the high-range side gain is rendered adjustable according to the liking of the user.

The preparation of the codebook used in the speech bandwidth expansion device 9 is hereinafter explained.

The codebook is prepared by a well-known method employing the GLA (generalized Lloyd algorithm). The broad-band speech is split into frames of a pre-set time duration, such as 20 msec, and the autocorrelation up to a pre-set order, such as sixth order, is found on the frame basis.

With the frame-based autocorrelation as the training data, a six-dimensional codebook is prepared. At this time, distinction may be made between the voiced and the unvoiced and the autocorrelation for the voiced sound and that for the unvoiced sound may separately be collected to prepare respective codebooks. When expanding $\alpha$ during band expanding processing, reference is had to the codebook. At this time, distinction is again made between the voiced and the unvoiced and the associated codebook is used.

Figure 9:
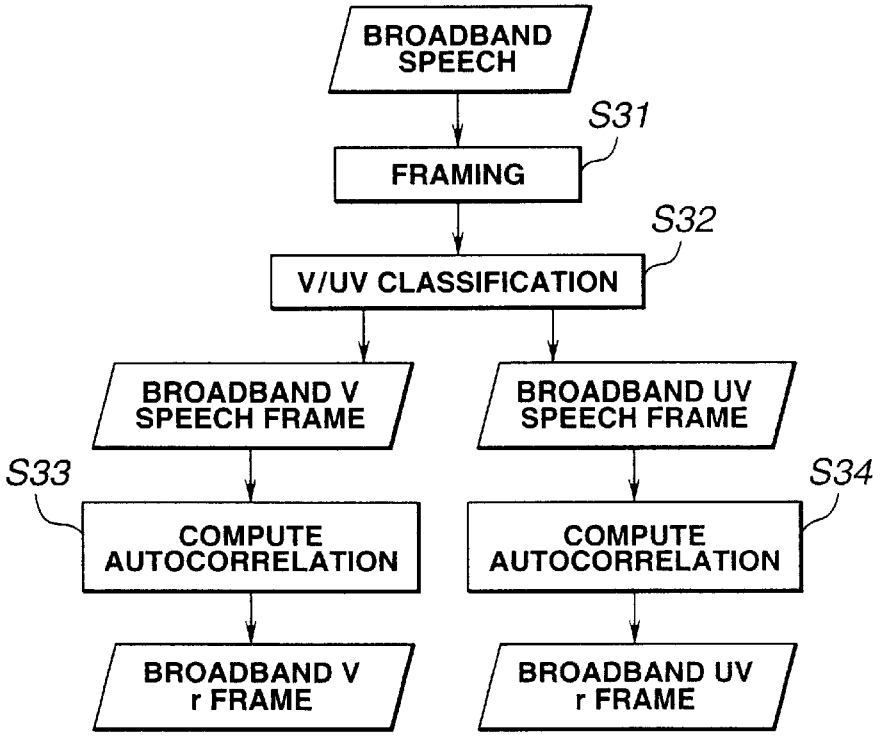
FIG. 9 is a block diagram for generating training data.
Figure 10:
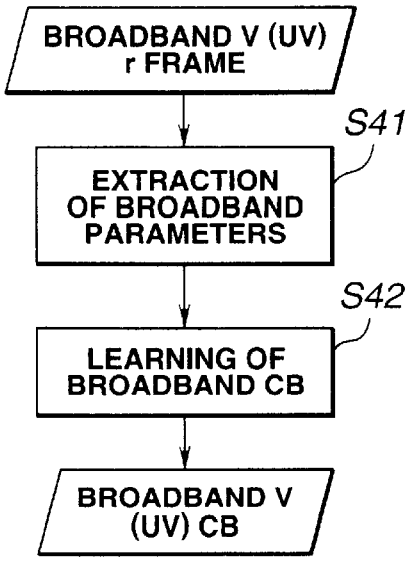
FIG. 10 is a block diagram for codebook generation.

The speech bandwidth expansion device 9 uses a codebook for broad-band voiced speech 12 and a codebook for broad-band unvoiced speech 14. Referring to FIGS. 9 and 10, the preparation of these codebooks is explained in detail.

First, broad-band speech signals are provided for learning and framed at step S31. Then, at step S32, the frame energy or zero-crossing value is checked at each frame at step S32 to make the V/UV classification.

At step S33, the autocorrelation parameter $\gamma$ up to, for example, the sixth order, is calculated in the broad-band voiced frame. At step S34, the autocorrelation parameter $\gamma$ up to, for example, the sixth order, is calculated in the broad-band unvoiced frame.

From the six-order autocorrelation parameter for each frame, the broad-band parameters are extracted at step S41 of FIG. 10 to prepare the order-six broad-band V (UV) codebook at step S42 by GLA.

In the above-described speech bandwidth expansion device, employing the decoding method by the PSI-CELP, the high range gain and the high range suppression filter may be rendered variable to provide the broad-band speech suited to the liking of the user.

Figure 3:
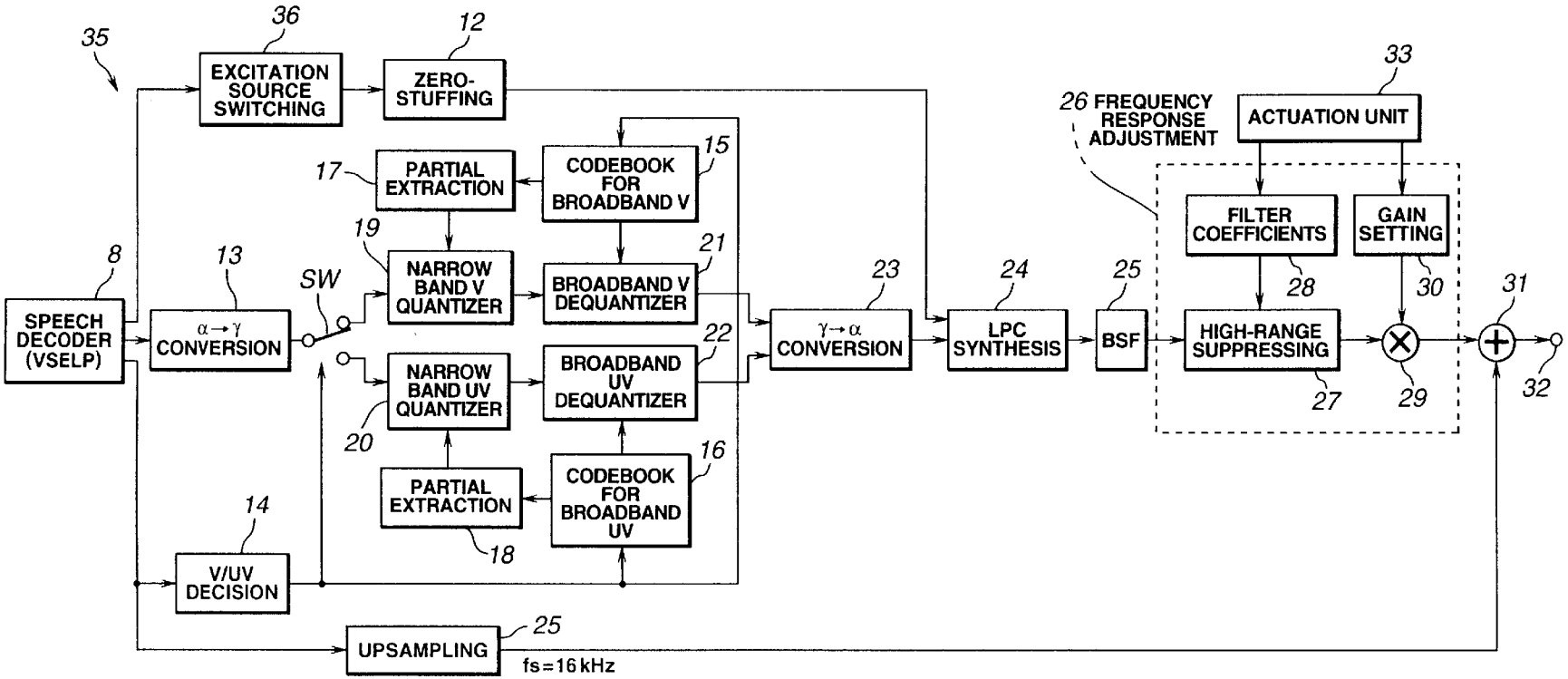
FIG. 3 is a block diagram showing a second embodiment of the speech bandwidth expansion device according to the first subject-matter of the present invention.

Referring to FIG. 3, a second embodiment of the speech bandwidth expansion device is explained. In this second embodiment, the speech bandwidth is expanded using encoded parameters sent from the speech encoder 3 on the transmitting side of the digital portable telephone device. Thus, the decoding method is the reverse of the encoding method used in the speech encoder 3.

If the encoding method in the speech encoder 3 is of the VSELP (vector sum excited linear prediction) system, the decoding method used in the speech decoder 8 in the upstream side of the speech bandwidth expansion device similarly is of the VSELP system.

The parameters concerning the excitation source, as the first encoded parameter among the encoded parameters, are sent to an excitation source changeover unit 36 shown in FIG. 3. The linear prediction coefficient $\alpha$, as the second encoded parameter among the encoded parameters, are sent to the $\alpha$ to $\gamma$ conversion circuit 13. The decoder signal is sent to the V/UV decision circuit 14.

The present embodiment differs from the speech bandwidth expansion device employing the PSI-CELP shown in FIG. 2 in providing the excitation source changeover unit 36 on the upstream side of the zero-padding unit 12.

Figure 6:
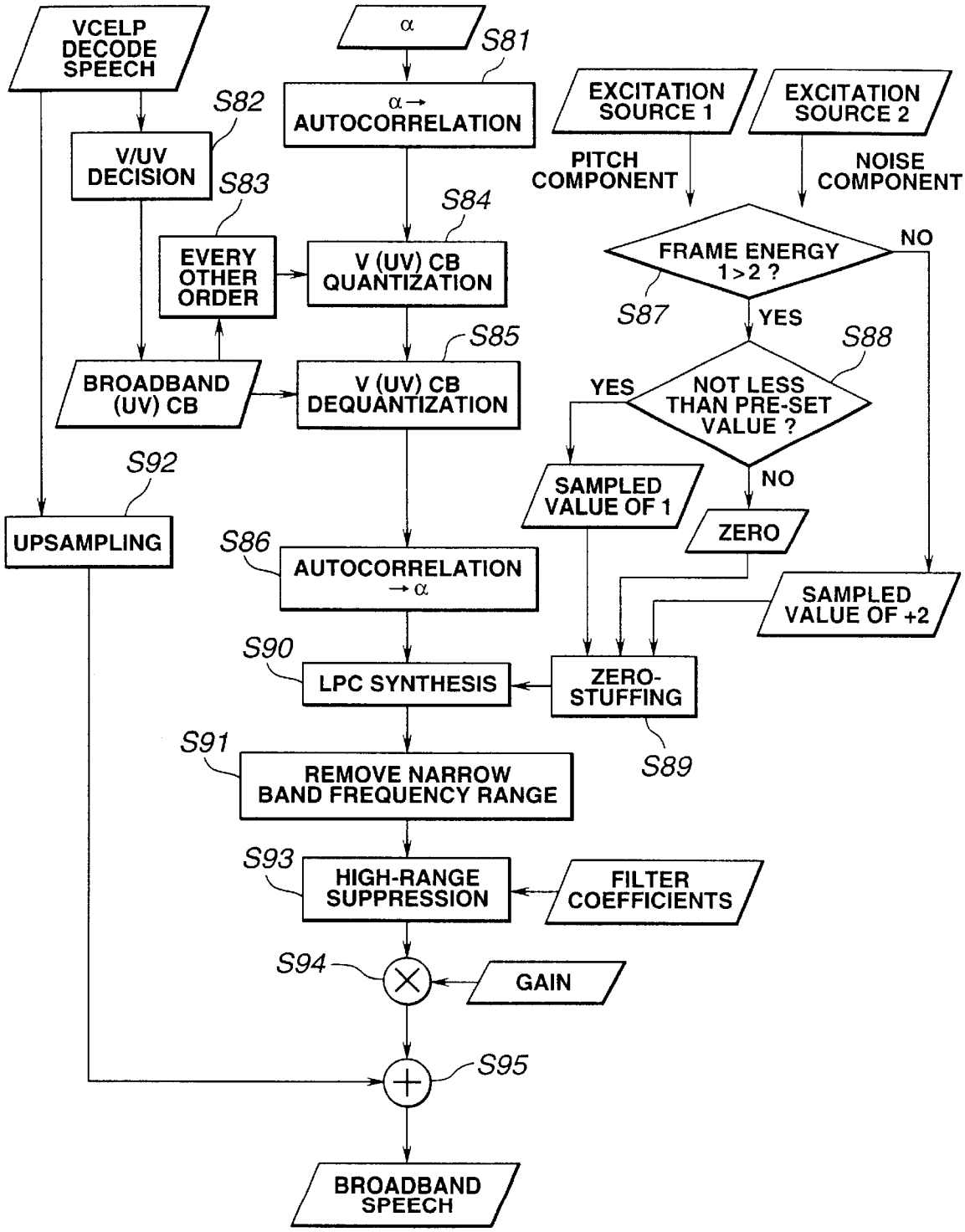
FIG. 6 is a block diagram of an embodiment of the present invention in which the VSELP system is applied to the present invention.

In the PSI-CELP, the codec itself performs psychoacoustic processing so that V in particular can be heard smoothly. The VSELP lacks in this processing, such that, on bandwidth expansion, V will be heard as if a minor amount of noise has been mixed into it. Therefore, when preparing the broad-band excitation source, processing such as is shown in FIG. 6 is performed by the excitation source changeover unit 36. This processing differs from the processing shown in FIG. 5 only with respect to steps S87 to S89.

The excitation source of VSELP is prepared as $\beta$*bL[i]+$\gamma$*c1[i] by the parameter $\beta$(long-term prediction coefficient), bL[i] (long-term filter state), $\gamma$ (gain) and c1[i] (excitation code vector). Since the former and the latter represent the pitch component and the noise component, respectively, it is divided into $\beta$*bL[i] and $\gamma$*c1 [i]. If, at step S87, the former is larger in energy, the signal is retained to be the voiced sound with strong pitch. Therfore, the YES path is taken at step S88, with the excitation source being a pulse train. In the absence of the pitch component, the NO path is taken for suppression to 0. If the energy is not large at step S87, the processing is as conventionally. The narrow-band excitation source is upsampled by zero stuffing by the zero-padding unit 12 at step S89 for use as an excitation source. This has improved the psychoacoustic quality of the voiced speech.

This processing, expressed in a software style, is as shown in the following equation (5):

```
if (Σ(β*bL[i])^2>Σ(γ*cl[t])^2) {
if (β*bL[i]>C|Max(β*bL[i])|{
exc_wide[2i]=β*bL[i];
}else{
exc_wide[2f]0;
}
)else{
exc_wide[2i]=β*bL[i]+γ*cl[i];
}
C: constant                                    (5).
```

Addition is made by the adder 31 at step S13 to an upsampled version by the upsampling circuit 25 of the original speech SNDN obtained at step S92. The high range side is filtered at step S94 by the high range suppression filter 27 adapted for slightly suppressing the component not less than approximately 6 kHz to yield a sound amenable to ears. The filter coefficients are selectable as mentioned previously.

At step S95, the high range side gain is rendered adjustable, using the multiplier 29, according to the liking of the user.

The present invention is not limited to prediction of the high range side from the low range side. Also, in the means for predicting the broad-band vector, the signal is not limited to the speech.

The present invention may also be applied to expanding the bandwidth in reproducing signals stored in a package medium.

Referring to the drawings, an embodiment of the second subject-matter of the present invention will be explained in detail. This embodiment is directed to a speech bandwidth expanding device for enlarging the bandwidth of an input narrow-band speech by employing the bandwidth expanding method according to the present invention. In the bandwidth expanding method, used by the present speech bandwidth expanding device, frequency components outside an input narrow-band range are predicted from parameters, from which narrow band signals can be synthesized. The predicted components are summed to the narrow-band signals, synthesized from the parameters, to enlarge the bandwidth. It is noted that, before summing the outside-range components to the narrow-band signals, the gain of the outside-range components are predicted based on the possible presence of the overflow that can be verified from the amount of addition.

This speech bandwidth expanding device is applied to a digital portable telephone device. First, the structure of the present digital portable telephone device is explained with reference to FIG. 1. Although the transmitter side and the receiver side are explained herein separately, these are actually enclosed together in a sole portable telephone device.

The transmitter side converts speech signals, entered at a microphone 1, into digital signals, by an A/D converter 2, and encoded by a speech encoder 3. Output bits are processed for transmission by a transmitter 4 and transmitted over an antenna.

At this time, the speech encoder 3 sends to the transmitter 4 encoded parameters which take into account the bandwidth narrowing limited by the transmission path. Examples of the encoding parameters include parameters concerning the excitation source and linear prediction coefficients $\alpha$.

The receiver side receives the electric wave captured by the antenna 6 by a receiver 7. A speech decoder 8 decodes the encoding parameters. A speech bandwidth expanding device 9 expands the speech using the decoded parameters. The speech then is restored to analog signals by a D/A converter 10 and outputted at a speaker 11.

Figure 4:
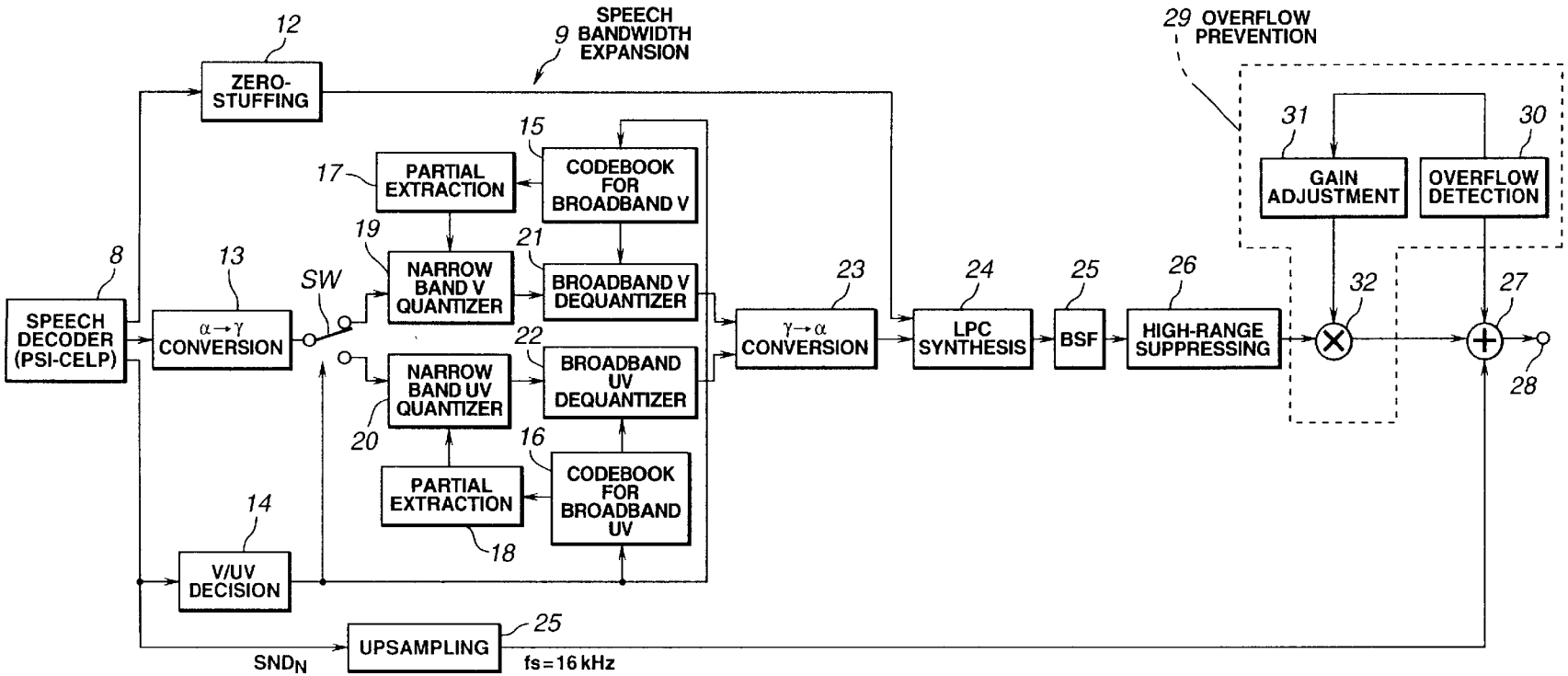
FIG. 4 is a block diagram of a speech bandwidth expansion device according to the second subject-matter of the present invention.

A specified embodiment of the speech bandwidth expanding device 9 in this digital portable telephone device is shown in FIG. 4. This speech bandwidth expanding device 9, shown in FIG. 4, expands the bandwidth of the speech using the encoded parameters sent from the speech encoder 3 arranged on the transmitter side of the digital portable telephone device.

The encoded parameters are decoded by the speech decoder 8. If the encoding method used in the speech encoder 3 is the pitch synchronous innovation-CELP (PSI-CELP) encoding system, the decoding method by this speech decoder 8 is also of the PSI-CELP system.

The parameters concerning the excitation source, as the first encoding parameter, among the encoded parameters decoded by the speech decoder 8, are routed to a zero-padding unit 12. The linear prediction coefficients $\alpha$, as the second encoded parameter among the above-mentioned encoded parameters, are routed to an $\alpha$ to $\gamma$ conversion circuit 13 adapted for conversion from linear prediction coefficients to autocorrelation. Also, decoded signals from the speech decoder 8 are routed to a V/UV decision circuit 14.

The speech bandwidth expanding device 9 includes, in addition to the zero-padding unit 12, $\alpha$ to $\gamma$ conversion circuit 13 and the V/UV decision circuit 14, a codebook for broad-band voiced sound 15 and a codebook for broad-band unvoiced sound 16. These codebooks 15, 16 are formulated at the outset using parameters for voiced speech and unvoiced speech, extracted from the broad-band voiced and unvoiced speech, respectively.

The speech bandwidth expanding device 9 also includes a partial extraction circuit 17 and a partial extraction circuit 18, for partially extracting respective code vectors in the codebook for broad-band voiced sound 15 and the codebook for broad-band unvoiced sound 16, to find narrow-band parameters, and a quantizer for narrow-band voiced speech 19 for quantizing the autocorrelation for narrow-band voiced speech from the $\alpha$ to $\gamma$ conversion circuit 13, using narrow-band parameters from the partial extraction circuit 17. The speech bandwidth expanding device 9 also includes a quantizer for narrow-band unvoiced speech 20 for quantizing the autocorrelation for narrow-band unvoiced speech from the $\alpha$ to $\gamma$ conversion circuit 13, using narrow-band parameters from the partial extraction circuit 18. The speech bandwidth expanding device 9 also includes a dequantizer for broad-band voiced speech 21 for dequantizing the quantized data for narrow-band voiced speech from the quantizer for narrow-band voiced speech 19 using the codebook for broad-band voiced sound 15 and a dequantizer for broad-band unvoiced speech 22 for dequantizing quantized data for narrow band unvoiced sound from the quantizer for narrow-band unvoiced speech 20 using the codebook for broad-band unvoiced sound 16. The speech bandwidth expanding device 9 also includes a autocorrelation to linear prediction coefficient conversion circuit ($\gamma$ to $\alpha$ conversion circuit 23) for converting the autocorrelation for broad-band voiced speech, which proves the dequantized data from the dequantizer for broad-band voiced speech 21 into linear prediction coefficients for broad-band voiced speech and for converting the autocorrelation for broad-band unvoiced speech, which proves the dequantized data from the dequantizer for broad-band unvoiced speech 22, into linear prediction coefficients for broad-band unvoiced speech. The speech bandwidth expanding device 9 also includes a LPC synthesis circuit 24 for synthesizing the broad-band speech based on the linear prediction coefficients for broad-band voiced speech, linear prediction coefficients for broad-band unvoiced speech from the $\gamma$ to $\alpha$ conversion circuit 23 and the excitation source from the zero-padding unit 12.

The speech bandwidth expanding device 9 also includes an upsampling circuit 25 for oversampling the sampling frequency for the narrow-band speech data decoded by the speech decoder 8 from 8 kHz to 16 kHz, and a band-stop filter (BSF) 25 for removing signal components of the frequency range of narrow-band input speech data of 300 to 3400 kHz from a synthesized output from the LPC synthesis circuit 24. The speech bandwidth expansion device 9 further includes a high-range suppressing filter 26 for suppressing the high frequency range not less than 3400 Hz from the BSF 25 and an adder 27 for summing the original narrow-band speech data components of 300 to 3400 Hz from the upsampling circuit 25 with the sampling frequency of 16 kHz to the filtered output of the high-range suppressing filter 26.

The present speech bandwidth expansion device 9 also includes, between the high-range suppressing filter 26 and the adder 27, an overflow preventative unit 29, operating in accordance with the signal processing method according to the present invention. This overflow preventative unit 29 operates so that, before the signal of the subsidiary system, corresponding to the broad-band signal obtained on LPC synthesis using parameters decoded from the encoded parameters, less 300 to 3400 Hz, is summed by the adder 27 to the main signal, that is the narrow-band speech signal of 300 to 3400 Hz, upsampled by the upsampling circuit 25, the gain of the subsidiary system is adjusted previously on the basis of the possible presence of the overflow that can be verified from the amount of addition, in order to prevent overflow from occurring.

To this end, the overflow preventative unit 29 includes an overflow detection unit 30 for detecting the possible presence of overflow from the amount of addition of the adder 27, a gain adjustment unit 31 for adjusting the gain based on the result of detection from the overflow detection unit 30, and a multiplier 32 for multiplying the signal of the subsidiary system by the gain adjusted by the gain adjustment unit 31.

If the overflow preventative unit 29 verifies that the overflow has occurred, it lowers the gain of the sample of the sub-signal in question to a level for which the overflow may be verified to be absent. The overflow preventative unit 29 then raises the gain gradually for the next and following samples, as zero overflow is maintained, until the initial gain is restored.

An output terminal 28 outputs digital speech signals with the frequency range of 300 to 7000 Hz and with the sampling frequency of 16 kHz.

This speech bandwidth expanding device 9 in its entirety operates as follows: First, the speech bandwidth expanding device 9 estimates parameters for a broad range from parameters for a narrow range to find the speech signals for broad range by the LPC synthesis circuit 24. The speech bandwidth expanding device 9 then substitutes the low-range side corresponding to the frequency range of the original speech for the original speech. Specifically, the device uses the BSF 25 as the high pass filter to leave only the high range and suppresses the highest frequency component of the high range by the high range suppression filter 27. The device then adjusts the gain by the overflow preventative unit 29 to sum the resulting signal to the original speech.

For estimating the broad range parameters, it is necessary to enlarge not only the band for $\alpha$ but also that of the excitation source. For enlarging the band for $\alpha$, a codebook by the autocorrelation $\gamma$, as a parameter that can be converted to and from $\alpha$, needs to be formulated at the outset. The autocorrelation $\gamma$ is enlarged in the frequency range by quantization and dequantization by the codebook.

First, the band enlargement for $\alpha$ is explained. Taking into account the fact that $\alpha$ is a filter coefficient representing the spectral envelope, it is first converted into the autocorrelation $\gamma$, which is a parameter representing another spectral envelope which allows for estimation of the high range side more easily. This autocorrelation $\gamma$ is enlarged in the frequency range and subsequently converted from the broad-range autocorrelation $\gamma w$ back to $\alpha w$. For expansion, vector quantization is used. It suffices if the narrow-band autocorrelation $\gamma n$ is vector-quantized and to find the corresponding $\gamma w$ from its index.

Since a predetermined relationship holds between the narrow-band autocorrelation and broad-band autocorrelation, as later explained, it suffices to provide only a codebook by broad-band autocorrelation. The narrow-band autocorrelation can thereby be vector-quantized and dequantized to find the broad-band autocorrelation.

If assumed that the narrow-band autocorrelation is the band-limited broad-band autocorrelation, the following relation:

$$\Phi(x_n)=\Phi(x_w\hat{X}h)=\Phi(x_w)\hat{X}\Phi(h) \tag{1}$$

holds between the narrow-band autocorrelation and the broad-band autocorrelation, where $\Phi$ is autocorrelation, xn is the narrow-band signal, xw is the broad band signal and h is the impulse response of the band-limiting filter.

From the relation between the autocorrelation and the power spectrum, the following equation (2):

$$\Phi(h)=F^{-1}(|H|^2) \tag{2}$$

is obtained.

If another band-limiting filter, having frequency characteristics equal to power characteristics of the aforementioned band-limiting filter, is considered, and termed H', the above equation may be rewritten to:

$$\Phi(h)=F^{-1}(|H|^2)=F^{-1}(H')=h' \tag{3}$$

The passband and stop band of this new filter are equivalent to those of the initial band-limiting filter, with the attenuation characteristics being squared. In this consideration, the narrow-band autocorrelation may be simplified as being the convolution of the broad-band autocorrelation and the impulse response of the band-limiting filter, that is a band-limited version of the broad-band autocorrelation. That is, the following equation:

$$\Phi(x_n)=\Phi(x_w)\hat{X}h' \tag{4}$$

is derived.

It is seen from above that, in vector quantizing the narrow-band autocorrelation, it is sufficient if only the broad-band codebook is provided, suice the narrow-band autocorrelation required for quantization can be prepared by computation. Thus, there is no necessity of providing a codebook from the narrow-band autocorrelation from the outset.

Moreover, since each $\gamma w$ code vector has a monotonously decreasing curve or a smoothly increasing or decreasing curve, no marked change is produced on allowing the low range to be passed through H', such that $\gamma n$ quantization can be executed directly by a $\gamma w$ codebook. However, since the sampling frequency is ½, it is necessary to perform comparison every other order.

Since $\alpha$ can be expanded to higher precision by splitting into the voiced (V) and the unvoiced (UV), this also is executed. Accordingly, two codebooks, namely a codebook for U and a codebook for UV, are used.

The expansion of the excitation source is now explained. In the PSI-CELP, an excitation source in the narrow band, upsampled on zero stuffing in the zero-padding unit 12 to generate aliasing distortion, is used. Although this method is extremely simple, the excitation source used may be said to be of sufficient quality since the difference of the harmonic structure and the power of the original speech are preserved.

From the broad band $\alpha$, obtained as described above, and the broad-band excitation source, LPC synthesis is performed by the LPC synthesis circuit 24.

Since the broad-band LPC synthesized speech as such is inferior in quality, its low-range side is replaced by the original speech SNDN outputted by the codec. The component of the synthesized speech higher than 3.4 kHz is extracted, whilst the codec output is upsampled by fs=16 kHz and added to the extracted speech.

At this time, the high-range side gain is rendered adjustable, according to the user's liking. In view of the marked personal difference, from user to user, this value is rendered variable. The value of the high range side gain is pre-set by user input and referred to in multiplication.

Also, the high-range side is side is filtered to slightly suppress the components not less than approximately 6 kHz to render the sound more amenable to the user. Since the filter coefficient is selectable, and processing is carried out by a pre-selected filter, the high range side frequency can be selected according to the user's liking. This filter selection is also set on user input. The broad range speech is obtained by the processing described above.

If the gain is increased in adding the synthesized high-range signal to the original low range signal, overflow tends to be produced. Since this overflow is not desirable, such that countermeasures such as clipping at the maximum value or adjustment of the signal power in its entirety have so far been used. This, however, is not desirable in an application such as band expansion. It is preferred to keep the low-range signals unchanged as far as possible.

To this end, the speech bandwidth expansion device 9 shown in FIG. 4 prohibits overflow by employing the overflow preventative unit 29, as mentioned previously. If, during addition of the low and high ranges, overflow has occurred in a sample, the high range gain is lowered in this sample to a level free from overflow before proceeding to the addition. However, for reducing the processing volume, the high range gain may be reduced to zero in the sample suffering from overflow. This evades the overflow insofar as this sample is concerned.

However, the processing for only the sample suffering from overflow is not spontaneous and hence unrecommendable since the gain is varied on the sample basis. Thus, as from this sample, the gain is restored to the setting gain within a range not producing the overflow, instead of at a time, even although no overflow is occurring in the following samples. This processing is applied even if overflow occurs during gain increasing processing.

The detailed operation of the speech bandwidth expanding device 9 is now explained by referring to the flowchart of FIG. 5.

At step S1, the $\alpha$ to $\gamma$ conversion circuit 13 converts the linear prediction coefficient $\alpha$, decoded by the speech decoder 8, into autocorrelation $\gamma$. The signal decoded by the speech decoder 8 is decoded by the V/UV decision circuit 14 at step Surface processed film 2 to verify V/UV.

If the V/UV decision flag is verified at this step S2 to be V, a switch SW, used to change over an output of the $\alpha$ to $\gamma$ conversion circuit 13, is connected to the quantizer for narrow-band voiced speech 19. If the flag is decided to be UV, the switch SW connects an output of the $\alpha$ to $\gamma$ conversion circuit 13 to the quantizer for narrow-band unvoiced speech 20.

If the V/UV decision circuit 14 decides the V/UV decision flag to be V, the autocorrelation for voiced speech $\gamma$ from the switch SW is sent at step S4 to the quantizer for narrow-band voiced speech 19 for quantization. For this quantization, the parameter for the narrow band V, found at step S3 by the partial extraction circuit 17, is used.

If the V/UV decision circuit 14 decides the V/UV decision flag to be UV, the autocorrelation for voiced speech $\gamma$ from the switch SW is sent at step S3 to the quantizer for narrow-band UV 20 for quantization. For this quantization, the parameter for the narrow band UV, found by processing by the partial extraction circuit 18, is used.

At step S5, the quantized autocorrelation is dequantized by the dequantizer for broad-band voiced speech 21 or the dequantizer for broad-band unvoiced speech 22, using the codebook for broad-band voiced sound 15 or the codebook for broad-band unvoiced sound 16, respectively, to produce the autocorrelation for broad band.

The autocorrelation for broad band is converted at step S6 to $\alpha$ by the $\gamma$ to $\alpha$ conversion circuit 23.

On the other hand, the parameter concerning the excitation source from the speech decoder 8 is upsampled at step S7 by zero stuffing between samples by the zero-padding unit 12 and enlarged in bandwidth on aliasing. The resulting parameter is sent as the broad-band excitation source to the LPC synthesis circuit 24.

At step S8, the LPC synthesis circuit 24 synthesizes the broad-band $\alpha$ and the broad-band excitation source by LPC synthesis to produce broad-band speech signals.

However, the resulting signals are inferior in quality since these are merely broad-band signals as found by prediction and are corrupted by prediction error. In particular, insofar as the frequency range of the narrow-band input speech is concerned, it is more preferred to directly use the original speech SNDN (input speech) outputted by the codec.

Thus, of the synthesized speech from the LPC synthesis circuit 24, the frequency range of 300 to 3400 Hz of the narrow-band input speech is filtered off at step S9 using the BSF 25.

The filtered output is summed by the adder 27 at step S13 to an upsampled version of the original speech SNDN obtained by the upsampling circuit 25 at step S10. At this time, the high-range side gain is rendered adjustable according to the liking of the user.

Prior to addition, the high-range side is filtered at step S11 by the high range suppression filter 26, designed for slightly suppressing the component not lower than approximately 6 kHz, to render the sound more amenable to the ear. The filter coefficient can be selected as described above.

At step S12, the overflow preventative unit 29 prevents overflow from occurring. If overflow has occurred in a given sample during addition of the low and high ranges, the high range gain is lowered in the sample to a level exempt from overflow before proceeding to the addition.

Figure 7:
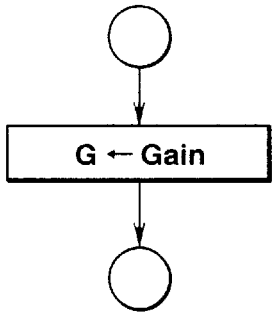
FIG. 7 is a flowchart for illustrating the operation of a signal processing unit configured for overflow prevention.
Figure 8:
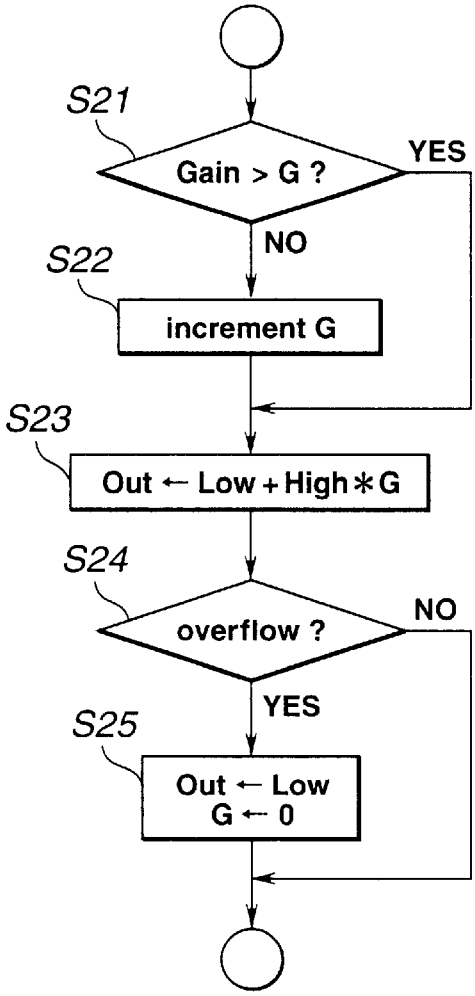
FIG. 8 is a flowchart for illustrating the operation of the overflow preventing unit.

The processing flow in the overflow preventative unit 29 is shown in FIGS. 7 and 8. It is assumed that the gain Gain is set as the initial value of the high-range gain. This Gain is copied in a variable G, as shown in FIG. 7.

FIG. 8 holds for each sample. Since G is usually equal to Gain, the result of decision step S21 is $\gamma$. Therefore. the program moves to step S23 to multiply the high-range signal with G. The resulting signal is added to the low-range signal by the adder 27 so as to be outputted as a broad-band speech signal at an output terminal 28. However, if overflow has occurred at step S24, that is if the overflow detection unit 30 has detected the overflow, G is set to zero at step S26 by the gain adjustment unit 31. Since the high-range signal is set to 0 by the multiplier 32, the low-range signal directly is outputted from the adder 27. The altered G remains valid for the next and the following samples. If G is smaller than the Gain at step S21, G is increased at step S22 within a range not exceeding the Gain, so that G is gradually restored to the Gain. However, if overflow has occurred at step S24 in the G increasing domain, G is again restored to zero.

The preparation of the codebook used in the speech bandwidth expansion device 9 is hereinafter explained.

The codebook is prepared by a well-known method employing the GLA (generalized Lloyd algorithm). The broad-band speech is split into frames of a pre-set time duration, such as 20 msec, and the autocorrelation up to a pre-set order, such as sixth order, is found on the frame basis. With the frame-based autocorrelation as the training data, a six-dimensional codebook is prepared. At this time, distinction may be made between the voiced and the unvoiced and the autocorrelation for the voiced sound and that for the unvoiced sound may separately be collected to prepare respective codebooks. When expanding a during band expanding processing, reference is had to the codebook. At this time, distinction is again made between the voiced and the unvoiced and the associated codebook is used.

The speech bandwidth expansion device 9 uses a codebook for broad-band voiced speech 12 and a codebook for broad-band unvoiced speech 14. Referring to FIGS. 9 and 10, the preparation of these codebooks is explained in detail.

First, broad-band speech signals are provided for learning and framed at step S31 to 20 msec per frame. Then, at step S32, the frame energy or zero-crossing value is checked at each frame at step S32 to make the V/UV classification.

At step S33, the autocorrelation parameter γ up to, for example, the sixth order, is calculated in the broad-band voiced frame. At step S34, the autocorrelation parameter γ up to, for example, the sixth order, is calculated in the broad-band unvoiced frame.

From the six-order autocorrelation parameter for each frame, the broad-band parameters are extracted at step S41 of FIG. 10 to prepare the order-six broad-band V (UV) codebook at step S42 by GLA.

According to the present invention, described above, only the subsidiary high-range signals are adjusted to prevent the overflow from occurring. Moreover, since the signals following the sample in question are adjusted without appreciably increasing the processing volume, spontaneity in hearing can be achieved.

The present invention is not limited to prediction of the high range from the low range, while it is not limited to band expansion of speech signals.

The signal processing method and apparatus according to the present invention is not limited to the bandwidth expansion since it is similarly applicable to prevention of the overflow otherwise produced when adding signal of a sub system to those of the main system, provided that original signals as the signals of the main system are desirably not changed. Of course, the present invention is applicable not only to addition of speech signals but also to addition of video signals.

Referring to the drawings, a preferred embodiment of the third subject-matter of the present invention is hereinafter explained.

In the following, description is made of the speech bandwidth expanding method and apparatus and the speech synthesis method and apparatus, employing the VSELP system and the PSI-CELP system, as the PDC codec system, are explained.

In the preferred embodiment, the broad-band parameters are estimated from the narrow-band parameters and broad band LPC synthesis is executed, after which, in the synthesized speech signals, original speech signals are substituted for the low range side which is the frequency band of the original speech signals. That is, in the preferred embodiment, the synthesized speech signals are subjected to high-pass filtering to leave only the high range. Of the high-range components, the highest frequency component is suppressed and the gain is adjusted to sum the resulting signal to the original speech.

For estimating the broad range parameters, it is necessary to enlarge not only the band for linear prediction coefficient α but also that of the excitation source. It is noted that the linear prediction coefficient α is the parameter representing the spectral envelope, that is the format information. For enlarging the band for the linear prediction coefficient α, a codebook by the autocorrelation γ, as a parameter that can be converted to and from α, needs to be formulated at the outset. The autocorrelation γ is enlarged in the frequency range by quantization and dequantization by the codebook.

Referring to both FIGS. 5 and 6, the processing flow of expansion of the linear prediction coefficient α, expansion of the excitation source, broad-band LPC synthesis and low-range substitution, followed by the preparation of the codebooks, is explained. FIGS. 5 and 6 illustrate, in block diagrams, an embodiment as applied to the PSI-CELP system and an embodiment as applied to the VSELP system, respectively.

First, the band enlargement for α is explained.

Taking into account the fact that is a filter coefficient representing the spectral envelope, the high range side is first converted at parameter converting step S1 or S81 into the autocorrelation γ, which is aparameter representing another spectral envelope that allows for more facilitated estimation of the high range side. This autocorrelation γ then is enlarged in the frequency range and subsequently converted in the parameter back-converting step S6 or S86 from the broad-range autocorrelation γw back to the broad-band linear prediction coefficient αw.

For expansion (bandwidth broadening) of the autocorrelation γ, vector quantization is used. That is, it suffices if the narrow-band autocorrelation γn is vector-quantized at step S4 or S84 and if its index is vector-dequantized at vector dequantizing step S5 or S85 to find the corresponding broad-band autocorrelation γw from the index.

Since a predetermined relationship holds between the narrow-band autocorrelation and broad-band autocorrelation, as later explained, it suffices to provide only a codebook by broad-band autocorrelation. The narrow-band autocorrelation can thereby be vector-quantized and dequantized to find the broad-band autocorrelation.

If assumed that the narrow-band autocorrelation is the band-limited broad-band autocorrelation, the following relation:

$$\Phi(x_n)=\Phi(x_w\hat{X}h)=\Phi(x_w)\hat{X}\Phi(h) \tag{1}$$

holds between the narrow-band autocorrelation and the broad-band autocorrelation, where Φ is autocorrelation, xn is the narrow-band signal, xw is the broad band signal and h is the impulse response of the band-limiting filter.

From the relation between the autocorrelation and the power spectrum, the following equation (2):

$$\Phi(h)=F^{-1}(|H|^2) \tag{2}$$

is obtained.

If another band-limiting filter, having frequency characteristics equal to power characteristics of the aforementioned band-limiting filter, is considered, and termed H', the following equation:

$$\Phi(h)=F^{-1}(|H|^2)=F^{-1}(H')=h' \tag{3}$$

is obtained.

The passband and stop band of this new filter are equivalent to those of the initial band-limiting filter, with the attenuation characteristics being squared. Therefore, this new filter also may be said to be a bandwidth-limiting filter.

In this consideration, the narrow-band autocorrelation may be simplified as being the convolution of the broad-band autocorrelation and the impulse response of the band-limiting filter, that is a band-limited version of the broad-band autocorrelation. That is, the following equation:

$$\Phi(x_n)=\Phi(x_w)\hat{X}h' \tag{4}$$

is derived.

It is seen from above that, in vector quantizing the narrow-band autocorrelation, it is sufficient if only the broad-band codebook is provided, since the narrow-band autocorrelation required for quantization can be prepared by computation. Thus, there is no necessity of providing a codebook from the narrow-band autocorrelation from the outset.

Moreover, since each γw code vector has a monotonously decreasing curve or a smoothly increasing or decreasing curve, no marked change is produced on allowing the low range to be passed through the bandwidth-limiting filter H', such that γn quantization can be executed directly by a γw codebook. However, since the sampling frequency is ½, it is necessary to perform comparison between every γw code vector taken at the every second order taking unit 4 and γw.

Meanwhile, the autocorrelation parameter can be obtained up to the tenth order for the narrow range in case of PDC. As the properties of the autocorrelation parameter, the smaller the number of orders, the rougher is the texture that can be expressed by the parameter, whereas, the larger the number of orders, the finer is the texture that can be expressed by the parameter. Therefore, in the broad band speech, with the raised sampling frequency, the autocorrelation up to the 20th order is naturally required. In the preferred embodiment, since more importance is attached to the rough spectral envelope, whist saving in the poro volume or memory capacity is desirable. Therefore, the autocorrelation parameter is found only up to the order six or thereabouts, and hence the broad-band codebook in this case is of the order six.

The expansion of the linear expansion coefficient may be improved in accuracy by splitting into the voiced (V) and unvoiced (UV). Therefore, this splitting is used in the preferred embodiment. That is, the decoded speech signal is discriminated by the V/UV decision unit at step S2 or S82 and the result of discrimination is used in the processing. Thus, for the codebook used at vector quantization step S4 or S84 and the codebook used at vector quantization step S5 or S85, two codebooks, that is a codebook for voiced (V) and a codebook for unvoiced (UV), are used.

The expansion of the excitation source is now explained.

In the PSI-CELP system, used in FIG. 5, an excitation source in the narrow band, upsampled on zero stuffing in the zero-padding step 7 to generate aliasing distortion, is used. Although this method is extremely simple, the excitation source used may be said to be of sufficient quality since the power of the original speech and the difference of the harmonic structure are preserved.

However, in the VSELP system, used in FIG. 6, the vowel sound in the original speech is turbid. If the above-described method of zero padding in the excitation source is directly used, there is left harsh noise in the high range. In order to improve this, the following processing is used in the preferred embodiment shown in FIG. 6.

The excitation source of VSELP is prepared as β*bL[i]+γ*cl[i] by the parameter β (long-term prediction coefficient), bL[i] (long-term filter state), γ (gain) and cl [i] (excitation code vector). Since the former and the latter represent the pitch component and the noise component, respectively, it is divided into β*bL[i] (first excitation source E1) and γ*cl[i] (second excitation source E2). These energies are compared to each other at the frame energy comparison step S87. If the former (first excitation source E1) is larger in energy, importance is attached only to the pitch component and the excitation source is retained to be a pulse train. At the pitch component detection step S88, it is detected whether or not the sample value of the first excitation source E1 exceeds a pre-set value,that is whether or not there is the pitch component. If there is the pitch component, the sample value of the first excitation source E1 is used, whereas, if there is no pitch component, the energy is suppressed to zero. If the result of decision of the frame energy comparison step S87 indicates that the energy of the first excitation source E1 is not larger than that of the second excitation source, the sum of the first excitation source E1 and the second excitation source E2 is used, as conventionally. The narrow-range excitation source, thus prepared, is stuffed with zeroes at the zero-padding step S89, as in the PSI-CELP system, to generate the broad-band excitation source. This processing can be written in the C-fashion by the following equation (5):

```
if (Σ(α*bL[i])^2>Σ(γ*cl[i])^2){
if (β*bL[i]>C|Max(β*bL[i]|){
exc_wide[2i]=β*bL[i];
}else{
exc_wide[2f]=0;
}
)else{
exc_wide[2i]=β*bL[i]+γ*cl[i];
}
C:constant                                    (5).
```

Then, as the broad-band LPC synthesis, LPC synthesis is executed at the LPC synthesis steps S8 or S90 by the broad-band prediction coefficient α and the broad-range excitation source, obtained as described above.

The low-range substitution is now explained.

The broad-band LPC synthesized speech, obtained at step S8 or S90, is corrupted with prediction error, especially due to reduction of the number of formants, and as such is inferior in quality. Thus, in the preferred embodiment, its low-range side is replaced by the original speech SNDN outputted by the codec. To this end, the component of the synthesized speech from the LPC synthesis steps S8 or S90 higher than 4 kHz is extracted at the narrow frequency range removing steep S9 or S91, whilst the codec output is upsampled by fs=16 kHz at upsampling step S10 or S92. These are added to the extracted speech at the addition step S13 or S96.

At this time, the high-range side gain is rendered adjustable, according to the user's liking. In view of the marked personal difference, from user to user, it is crucial to render this value subject to alteration. Thus, in the preferred embodiment, the value of the high range side gain is pre-set by user input and referred to in multiplication of the gain value at multiplication step S12 or S94 to adjust the high range side gain. Also, the high-range side is filtered at high-range suppressing step S11 or S93 prior to the addition at the addition step S13 or S95 to slightly suppress the components not less than approximately 6 kHz to render the sound more amenable to the user. This filter coefficient is selectable, such that, by performing filtering using the pre-selected filter coefficient, the high range side frequency range can be selected as desired. This filter can be set by user input.

This high range suppressing filtering at this high range suppressing filtering step S11 or S93 can be performed after addition at step S13 or S95 so as not to affect low range side power characteristics. Alternatively, the filtering which might affect the low range side can also be intentionally performed after addition at the addition step S13 or S95.

The above processing gives the broad-range speech.

The preparation of the codebook used in the speech bandwidth expansion device 9 is hereinafter explained.

In the preferred embodiment, the codebook is prepared prior to performing the above-described bandwidth expanding processing. FIGS. 9 and 10 show block diagrams for generating codebook training data and for codebook generation, respectively.

The codebook is prepared by a well-known method employing the GLA (generalized Lloyd algorithm).

The broad-band speech is split into frames of a pre-set time duration, such as 20 msec, and the autocorrelation up to a pre-set order, such as sixth order, is found at the autocorrelation calculating steps S33 and S34, from one V frame to another, and from one UV frame to another. The frame-based autocorrelation $\gamma$ of each of the voiced speech (V) and the unvoiced speech (UV) serves as training data.

In the preferred embodiment, broad-band parameters are extracted from the frame-based autocorrelation $\gamma$ of the voiced sound (V) and unvoiced sound (UV) at the broad-band parameter extraction step S41. An order-six codebook then is prepared at the codebook learning unit step S42.

If distinction is made between the voiced sound and the unvoiced sound, autocorrelation of the voiced sound and that of unvoiced sound are collected separately, and respective codebooks are formulated, as described above, reference is had to the codebooks in expanding $\alpha$ during band expanding processing. At this time, distinction is again made between the voiced sound and the unvoiced sound, and the associated codebooks are utilized.

Meanwhile, codebooks may be formulated without making distinction between the voiced sound and the unvoiced sound.

In the preferred embodiment, as described above, importance is attached to the rough structure of the spectrum by reducing the number of broad-band formants to improve the quality of the produced broad-band speech. In addition, the memory capacity or the processing volume needed in codebook search are saved.

It is noted that parameters that can represent formants are not limited to the linear prediction coefficients $\alpha$ or autocorrelation $\gamma$. For example, line spectrum pairs (LSP) or partial autocorrelation coefficients (PARCOR coefficients), can be used. Also, the present invention is not limited to prediction from the low range to the high range, whilst it is not limited to the PDC system. The present invention is not limited to parameter transmission because it can be directly applied to the analog signals which are transmitted and subsequently digitized. Moreover, the present invention can be applied to systems not exploiting the transmission channel, in particular the automatic answering telephone or reply message, as functions of the portable terminals.

What is claimed is:

1. A bandwidth expanding method for expanding a bandwidth by estimating outside-band components from narrow-band signals or from parameters allowing for synthesizing the narrow-band signals comprising the steps of:

first adjusting frequency characteristics of said outside-band components by pre-set alterable parameter values; and subsequently adding said outside-band components having adjusted frequency characteristics to said narrow-band signals.

2. The bandwidth expanding method according to claim 1 wherein respective gains of said outside-band components are adjusted by adjusting said frequency characteristics.

3. The bandwidth expanding method according to claim 1 wherein a width of a frequency range of said outside-band components is adjusted by adjusting said frequency characteristics.

4. A bandwidth expanding method for expanding a bandwidth by estimating outside-band components from narrow-band signals or from parameters allowing for synthesizing the narrow-band signals comprising the steps of:

adding said outside-band components to said narrow-band signals; and adjusting frequency characteristics of said outside-band components after addition thereof to said narrow-band signals by pre-set alterable parameter values.

5. The bandwidth expanding method according to claim 4 wherein a width of a frequency range of said outside-band components is adjusted by adjusting said frequency characteristics.

6. A bandwidth expanding apparatus for expanding the bandwidth by estimating outside-band components from narrow-band signals or from parameters allowing for synthesizing the narrow-band signals, comprising:

frequency characteristics adjustment means for adjusting frequency characteristics of said outside-band components by pre-set alterable parameter values; and addition means for adding the outside-band components having frequency characteristics adjusted by said frequency characteristics adjustment means to said narrow-band signals.

7. The bandwidth expanding apparatus according to claim 6 wherein said frequency characteristics adjustment means includes means for adjusting respective gains of said outside-band components.

8. The bandwidth expanding apparatus according to claim 7 wherein said frequency characteristics adjustment means includes means for multiplexing said outside-band components by said pre-set alterable parameter values.

9. The bandwidth expanding apparatus according to claim 6 wherein said frequency characteristics adjustment means includes means for adjusting a width of a frequency range of said outside-band components.

10. The bandwidth expanding apparatus according to claim 9 wherein said frequency characteristics adjustment means includes means for adjusting the frequency range of said outside-band components based on pre-set alterable filter coefficients.

11. A bandwidth expanding apparatus for expanding the bandwidth by estimating outside-band components from narrow-band signals or from parameters allowing for synthesizing the narrow-band signals comprising:

addition means for adding said outside-band components to said narrow-band signals; and frequency characteristics adjustment means for adjusting frequency characteristics of said outside-band components of an addition output of said addition means by pre-set alterable parameters.

12. The bandwidth expanding apparatus according to claim 11 wherein the frequency characteristics adjustment means includes means for adjusting a frequency band of said outside-band components of the addition output of said addition means.

13. The bandwidth expanding apparatus according to claim 12 wherein the frequency characteristics adjustment means includes means for adjusting the frequency band of said outside-band components of the addition output of said addition means based on pre-set alterable filter coefficients.

14. A signal processing method for adding signals of a main system to signals of a subsidiary system, comprising the steps of prior to adding the signals of said subsidiary system to the signals of said main system, adjusting a gain of a given sample of the signals of said subsidiary system and adjusting a gain of samples following said given sample based on a presence or absence of an overflow determined from an amount of the addition.

15. The signal processing method according to claim 14 wherein when the overflow has been determined to be present the gain of the given sample of the signals of the subsidiary system is lowered until the overflow is determined to be absent, and wherein, for the following samples the gain is gradually increased as zero overflow is maintained, until an initial gain of the overflow is restored.

16. The signal processing method according to claim 14 wherein the signals of the main system are selected to be narrow-band signals and the selected to be signals of said subsidiary system are signals of a band not belonging to the narrow band.

17. A signal processing apparatus for signals of a main system and signals of a subsidiary system, comprising:

addition means for summing the signals of the subsidiary system to the signals of the main system;

overflow detection means for detecting a presence or absence of an overflow based on an amount of addition from said addition means;

gain adjustment means for adjusting a gain for a given sample and for following samples of the signals of said subsidiary system based on detected results from said overflow detection means; and multiplication means for multiplying said given sample and said following samples of the signals of the subsidiary system by an adjustment gain from said gain adjustment means.

18. The signal processing apparatus according to claim 17 wherein when the overflow has been determined to be present said overflow detection means lowers the gain of the given sample of the signals of the subsidiary system until the overflow can be determined to be absent, and wherein for the following samples said overflow detection means gradually increases the gain as zero overflow is maintained, until an initial gain of the overflow is restored.

19. The signal processing apparatus according to claim 17 wherein the signals of said main system are narrow-band signals and wherein the signals of the subsidiary system are signals of a band outside of said narrow band.

20. A bandwidth expanding method for expanding the bandwidth by estimating outside-band components from narrow-band signals or from parameters allowing for synthesizing the narrow-band signals, comprising the steps of:

prior to adding said outside-band components to said narrow-band signals, adjusting a gain of said outside-band components based on a presence or absence of an overflow determined from an amount of addition.

21. The bandwidth expanding method according to claim 20, wherein when the overflow has been determined to be present a gain of a given sample of the outside-band components is lowered until the overflow can be determined to be absent, and wherein for following samples the gain is gradually increased as zero overflow is maintained, until an initial gain of the overflow is restored.

22. A bandwidth expanding apparatus for expanding the bandwidth by estimating outside-band components from narrow-band signals or from parameters allowing for synthesizing the narrow-band signals, comprising:

addition means for summing said outside-band components to said narrow-band signals;

overflow detection means for detecting a presence or absence of an overflow that can be verified from an amount of addition from said addition means;

gain adjustment means for adjusting a gain for a given sample and following samples of the outside-band components based on detected results from said overflow detection means; and multiplication means for multiplying said given sample and following samples of the outside-band components by an adjustment gain from said gain adjustment means.

23. The bandwidth expanding apparatus according to claim 22, wherein when the overflow has been determined to be present said overflow detection means lowers the gain of the given sample of the signals of the subsidiary system until the overflow can be determined to be absent, and wherein for the following samples said overflow detection means gradually increase the gain as zero overflow is maintained, until an initial gain of the overflow is restored.

24. A speech synthesis method comprising:

a first parameter prediction step for predicting parameters that allow for representation of a number of broad band formants not larger than a number of narrow band formants from narrow band parameters representing an input narrow band speech and which allow for representation of the input narrow band speech;

a parameter extraction step for extracting parameters that allow representation of the narrow-band formant information from the input narrow band speech;

a second parameter prediction step for predicting a parameter that allows representation of a number of broad band formants not larger than the number of the produced narrow-band formants; and a synthesis step for synthesizing the broad-band speech from a parameter that allows for representation of the produced broad band formants.

25. The speech synthesis method according to claim 24 further comprising:

a substitution step for removing a frequency range corresponding to the narrow band speech signals from the synthesized broad band speech signals and for substituting the input narrow band speech signal for a removed frequency range.

26. A speech synthesis apparatus comprising:

first parameter prediction means for predicting parameters that allow for representation of a number of broad band formants not larger than a number of narrow band formants from narrow band parameters representing an input narrow band speech and which allow for representation of the input narrow band speech;

parameter extraction means for extracting parameters that allow representation of the narrow-band formant information from the input narrow band speech;

second parameter prediction means for predicting a parameter that allows representation of a number of broad band formants not larger than the number of the produced narrow-band formants; and synthesis means for synthesizing the broad-band speech from a parameter that allows for representation of the produced broad-band formants.

27. The speech synthesis apparatus according to claim 26 further comprising:

substitution means for removing a frequency range corresponding to the narrow band speech signals from the synthesized broad band speech signals and for substituting the input narrow band speech signal for a removed frequency range.

* * * * *